US007192083B2

(12) United States Patent
Mainstone

(10) Patent No.: US 7,192,083 B2
(45) Date of Patent: Mar. 20, 2007

(54) FOLDING LINKAGE

(75) Inventor: Marion Mainstone, London (GB)

(73) Assignee: The Folding Company Limited, London (GB)

( * ) Notice: Subject to any disclaimer, the term of this patent is extended or adjusted under 35 U.S.C. 154(b) by 103 days.

(21) Appl. No.: 10/466,407

(22) PCT Filed: Jan. 8, 2002

(86) PCT No.: PCT/IB02/00013

§ 371 (c)(1),
(2), (4) Date: Jul. 14, 2003

(87) PCT Pub. No.: WO02/054912

PCT Pub. Date: Jul. 18, 2002

(65) Prior Publication Data

US 2004/0056518 A1 Mar. 25, 2004

(30) Foreign Application Priority Data

Jan. 12, 2001 (GB) ..... 0100899.4

(51) Int. Cl.
*A47C 4/00* (2006.01)

(52) U.S. Cl. ..... 297/16.2; 297/16.1; 297/46

(58) Field of Classification Search ..... 297/16.1, 297/16.2, 53, 51, 52, 55, 57, 46, 47, 17
See application file for complete search history.

(56) References Cited

U.S. PATENT DOCUMENTS 667,986 A * 2/1901 Meade ..... 297/53
1,027,012 A * 5/1912 Stock et al. ..... 297/53
1,302,828 A * 5/1919 Miller ..... 297/54
1,571,538 A * 2/1926 Cable ..... 297/52
1,580,557 A * 4/1926 McGrew ..... 297/45
1,815,643 A * 7/1931 Allderding ..... 297/55
1,838,213 A * 12/1931 Buffington ..... 297/55
1,876,549 A * 9/1932 Bales ..... 297/41
1,922,305 A * 8/1933 Kovats ..... 297/47
2,225,306 A * 12/1940 Kovats ..... 297/47
2,555,113 A * 5/1951 Burnham ..... 297/55
3,450,432 A * 6/1969 Minsker ..... 297/17
3,815,952 A * 6/1974 Minsker ..... 297/47
4,456,294 A * 6/1984 Lange et al. ..... 297/21
6,279,991 B1 * 8/2001 Atkins et al. ..... 297/16.1
6,305,742 B1 * 10/2001 Spendlove et al. ..... 297/16.1

FOREIGN PATENT DOCUMENTS

FR 2640859 A1 * 6/1990

* cited by examiner

*Primary Examiner*—Peter M. Cuomo
*Assistant Examiner*—Sarah B. McPartlin
(74) *Attorney, Agent, or Firm*—Andrew Wilford

(57) ABSTRACT

A folding linkage, especially for a folding chair, has four pivoting bars. In the open position the first bar forms one side of a triangle. The second and third bars are colinear to form a second side of the triangle and the fourth bar forms the third side of a triangle in the closed position the four bars are substantially aligned. The fourth bar is joined to the first bar by a pivot which moves along a curved path.

19 Claims, 6 Drawing Sheets

FOLDING LINKAGE

CROSS REFERENCE TO RELATED APPLICATIONS

This application is a national stage of PCT iB02/00013 filed 8 Jan. 2002 and based upon UK national application 01 00 899.4 filed 12 Jan. 2001 under the International Convention.

FIELD OF THE INVENTION

The present invention relates to a folding linkage, that is, a structure formed from links that may be changed from a folded configuration to an unfolded or expanded configuration.

BACKGROUND OF THE INVENTION

Many articles include a folding linkage that enables them to change their shape, typically so that they are used in an unfolded state, and folded up when not in use in order to take up less space. Such articles include tables and chairs, platforms, awnings, doors and windows, and many other items.

A folding linkage should be convenient to operate, and should fold to a compact and preferably thin configuration in the folded state. It is also advantageous if the linkage is relatively simple to fabricate.

OBJECT OF THE INVENTION

The object of the present invention is to provide a folding linkage which is convenient to operate and provides a compact configuration.

SUMMARY OF THE INVENTION

According to the present invention there is provided a linkage mechanism including four pivoting bars, having an open position in which the first bar forms one side of a substantially triangular shape, the second and third bars are generally collinear to form the second side of the triangular shape, and the fourth bar forms the third side of the triangular shape, and a closed position in which the first bar, second bar, third bar and fourth bar are substantially aligned, the first bar being pivotally joined to the second bar, the second bar being pivotally joined to the third bar, the third bar being pivotally joined to the fourth bar, and the fourth bar being joined to the first bar by a pivot which may move along a path with respect to the first bar.

Preferably, the path is provided by a cammed surface of the first bar in which a pin attached to the fourth bar slidably abuts. The cammed surface may be a curved slot in which the pin slidably engages. The path may be additionally or alternatively is provided by a curved slot in the fourth bar in which a pin attached to the first bar slidably engages.

According to another aspect of the present invention, there is provided a linkage mechanism including four pivoting bars, having an open position in which the first bar forms one side of a substantially triangular shape, the second and third bars are generally collinear to form the second side of the triangular shape, and the fourth bar forms the third side of the triangular shape, and a closed position in which the first bar, second bar, third bar and fourth bar are substantially aligned, the first bar being pivotally joined to the second bar, the second bar being pivotally joined to the third bar, the third bar being pivotally joined to the fourth bar, and the fourth bar being pivotally joined to the first bar, the second bar and the third bar being constrained such that they pass through a precisely collinear relationship when the mechanism is transformed from the folded state to the open state and are held in a braced state in the open position when subjected to compressive forces, and there being provided a release member attached to the second and/or the third bar capable of displacement causing the second bar and third bar to pass through the precisely collinear relationship in order to remove the braced state so that the structure can be folded.

Preferably the release member comprises a bar which is slidably pivoted with the first bar, and the release bar may include a handle.

According to another aspect of the present invention, there is provided a folding chair, including a seat bar pivotally joined to a upper first leg bar, the upper first leg bar being pivotally joined to a lower first leg bar, the lower first leg bar being pivotally joined to a second leg bar, the second leg bar being pivotally joined to the seat bar, having an open position in which the seat bar forms one side of a substantially triangular shape, the upper first leg bar and lower first leg bar are generally collinear to form the second side of the triangular shape, and the fourth bar forms the third side of the triangular shape, and a closed position in which the first bar, second bar, third bar and fourth bar are substantially aligned.

Preferably the second leg bar is joined to the seat bar by a pivot which may move along a path with respect to the seat bar. Preferably the path is provided by a cammed surface of the seat bar in which a pin attached to the second leg bar slidably abuts. The cammed surface may be a curved slot in which the pin slidably engages. The path may additionally or alternatively be provided by a curved slot in the first leg bar in which a pin attached to the seat bar slidably engages.

BRIEF DESCRIPTION OF THE DRAWING

A folding linkage embodying the invention will now be described, by way of example, with reference to the drawings, of which.

SPECIFIC DESCRIPTION

Figure 1:
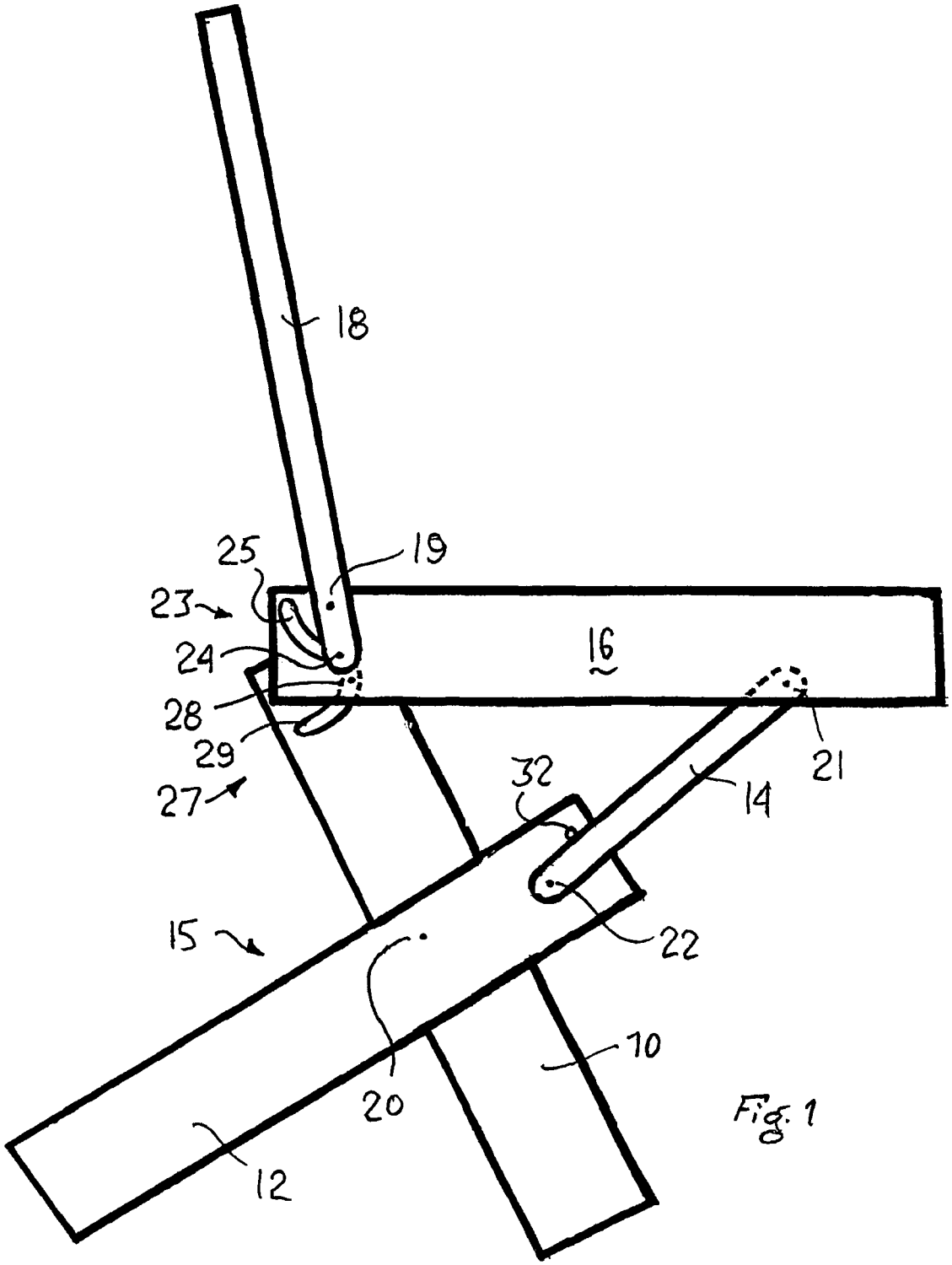
FIG. 1 shows a side elevation of a fully open chair using the linkage.

Referring to FIG. 1, the frame of the chair includes front leg strut 10, lower rear leg strut 12, upper rear leg strut 14, a seat strut 16 and a back strut 18. Typically a pair of such sets of struts, one for each side of the chair, will be present, the seat struts and back struts supporting a chair seat and a chair back respectively. Vertical cross members between the two sides of the chair may be included in a straightforward manner, and some pairs of struts could be formed from a single piece of material bent over to provided two parallel struts and a cross member in an integral manner.

Lower rear leg strut 12 is joined to upper rear leg strut 14 by pivot 22, and together they form the rear leg of the chair 15. The upper rear leg strut 14 is joined to the seat strut 16 by pivot 21. The front leg strut 10 is joined to the lower rear leg strut 12 by pivot 20. The front leg strut 10 and the seat strut 16 are joined by corresponding sliding pivots 23 and 27. Sliding pivot 23 comprises a pin 24 fixed to the front leg strut 10 and engaging in a curved slot or groove 25 in the seat strut 16. Sliding pivot 27 is similar, a pin 28 being fixed to seat strut 16 and engaging in a curved slot 29 in the front leg strut 10. The back strut 18 is both pivotally joined to the seat strut 16 at a pivot 19 and to the front leg strut 10 by the pin 24 of the front leg strut 10 extending through the thickness of the seat strut 16 at the slot 25.

The slots 25 and 29 of the seat strut 16 and the front leg 10 are arcs, the lower end of the seat strut's slot 25 being forward of the upper end, and the arc of the front leg strut 10 curving in the opposite sense to that of the seat strut's arc. In the chair's open position, the pin 24 of the front leg strut 10 is situated at the lower end of the curved slot 25, and the pin 28 of the seat strut 16 is situated at the upper end of the slot 29.

The struts define between the pivots a generally quadrilateral shape, or when open a generally triangular shape; for convenience, angles between struts falling inside the quadrilateral shall hereafter be referred to as internal angles.

The rear leg 15 includes a stop member 32 such as a pin on the lower rear leg strut 12 which laterally protrudes so as to abut the upper rear leg strut 14 when the chair is in the open position. When the chair is open, its weight, and the weight of a seated person if present, tends to act to cause the front leg strut 10 and the rear leg 15 to rotate about pivot 22, (so that the internal angle between the front leg strut 10 and the lower rear leg strut 12 increases). The upper rear leg strut 14 and lower rear leg strut 12 are in a generally, but not precisely, collinear arrangement in the open position. Weight acting downwards on the chair also urges the upper rear leg strut 14 to pivot about 22 to decrease the internal angle between the upper rear leg strut 14 and the lower rear leg strut 12. The stop member 32 of the lower rear leg strut 12 prevents such movement, so that the chair is braced in the open position by downwardly acting forces. In this position, the pin 24 of the front leg strut 10 will be situated at the lower point of the curved slot 25, and the pin 28 of the seat strut 16 will be situated at the upper end of the curved slot 29. The position of the pin 24 causes the back strut 18 to be held at its most reclined position.

The chair may conveniently be folded into a compact position by lifting the chair approximately at pivot 28 (the pivot pin 28 could extend the width of the chair to allow the user to pick the chair up from the centre of the chair's width), and applying a force to the unpivoted end of lower rear leg strut 12 so as to cause the lower rear leg strut 12 to rotate about pivot 20 to reduce the internal angle between the lower rear leg strut 12 and the front leg strut 10. It will be realised though that the chair may be folded in other ways, such as by rotating any two struts towards a folded position, or by picking up the chair from a point rear of the chair's centre of gravity.

Figure 2:
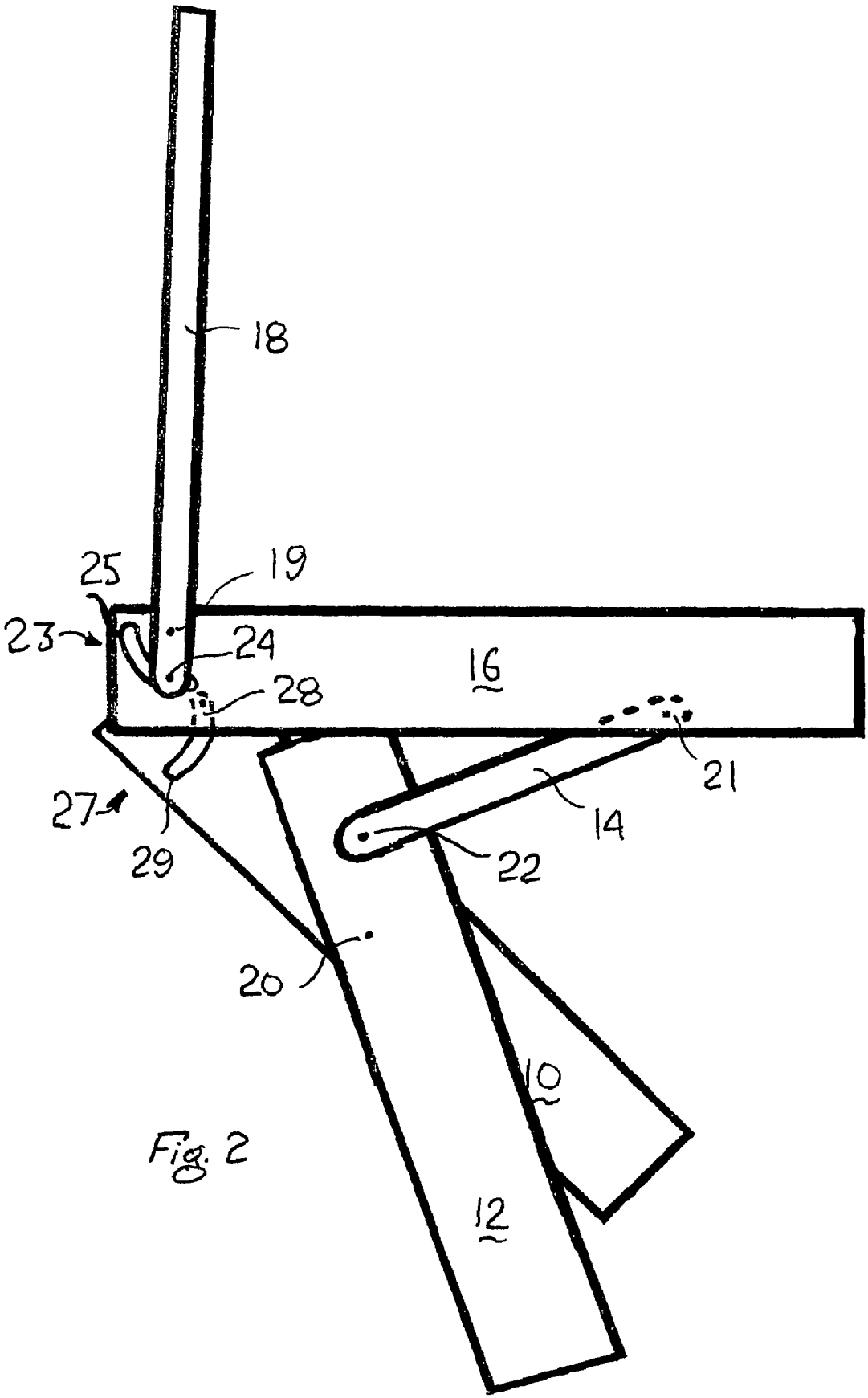
FIG. 2 shows a side elevation of the chair partially open.

Referring to FIG. 2, as the lower rear leg strut 12 pivots on pivot 20 about front leg strut 10, upper rear leg strut 14 pivots on pivot 22 about lower rear leg strut 12, increasing the internal angle between the upper rear leg strut 14 and the lower rear leg strut 12. The front leg strut 10 pivots about the sliding pivot 27. At the same time, the front leg strut 10 is generally caused to rotate relative to the seat strut 16 about the sliding pivots 23 and 27 so as to decrease the internal angle between these two struts 10 and 16. As the front leg strut 10 pivots in this manner, the pin 24 of the front leg strut 10 moves up the curved slot 25, and the pin 28 of the seat strut 16 moves down the curved slot 29. The movement of pin 24 causes the back strut 18 to pivot about 19 and fold downwards.

Figure 3:
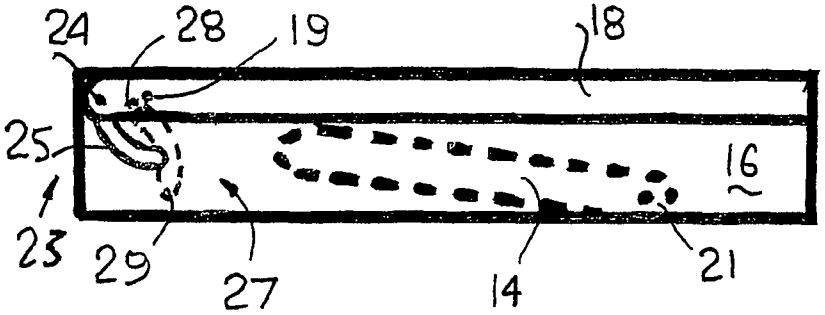
FIG. 3 shows a side elevation of the chair closed.

Referring to FIG. 3, maintenance of the force against the lower rear leg strut 12 continues these pivoting movements of the struts, until the chair is in the folded position. Considered from the side elevation, each strut is substantially collinear. The pin 24 of the front leg strut 10 is now situated at the upper point of the curved slot 25, and the pin 28 of the seat strut 16 is now at the lower end of the curved slot 29. In this manner the side profile of the front leg strut 10 is raised to substantially coincide with that of the seat strut 16, whilst in the open position the front leg strut 10 is set in a lower position relative to the seat strut, so that the chair provides a reasonable height of the ground with a compact configuration when folded.

Figure 4:
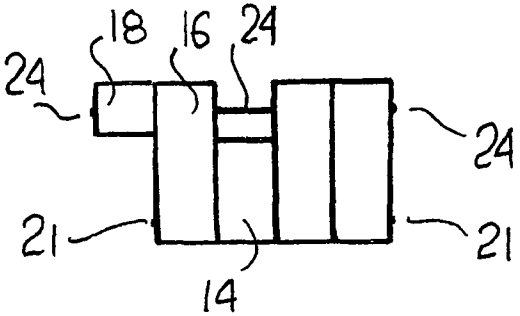
FIG. 4 shows a front elevation of the chair closed.

The upper rear leg strut 14 is set behind the seat strut 16 and the lower rear leg strut 12, when considered as a side elevation as illustrated in FIG. 3. Front leg strut 10 is set above the seat strut 16 and the lower rear leg strut 12. Referring to FIG. 4, when the struts are viewed end-on in their folded configuration, the seat strut 16 and the lower rear leg strut 12 substantially occupy the same plane, with the upper rear leg strut 14 and the front leg strut 10 each occupying different parallel planes.

Opening the chair from the folded position may be conveniently achieved by lifting the chair by the back strut 18 so that it rotates with respect to the seat strut 16 and the front leg strut 10. As the back strut 18 is lifted away from the other struts, the struts open in a constrained manner until the chair is open.

Although ideally a back strut 18 member is described here, it will be seen that the back could be hinged in a different or independent manner rather to folding linkage. Further, a folding stool having no back could be provided using only the other struts for the legs and seat.

The struts, pivots and sliding pivots of the embodiment above are such that the linkage has a single degree of freedom, I. e. the position and movement of any two struts determines the positions and movement of the remaining struts (with the qualification of course that the lower rear leg strut 12 and upper rear leg strut 14 have a small range when generally collinear where they may occupy two possible positions for any particular configuration of the other struts). The mechanism may be simplified by removing one of the slotted pivots, for example the chair may be provided only with the pin 28 and slot 29, dispensing with pin 24 and slot 25, progress of the pin in the slot being influenced by the action of the user folding the chair, the weight of the struts, or some other constraining means. The slot or slots need not be arcs, and where two slots are provided need not be the same shape, though changing the nature of the slots will change the manner in which the front leg strut 10 moves as the chair is folded and unfolded. Also, the slot may be provided by a cutaway portion having a cammed surface.

It will be seen that the chair may be configured in equivalent ways, for example, the front leg could be made up of two pivoting struts while the back leg is pivoted from the seat with a sliding pivot. It will also be seen that the stop means determining the open position could be provided in other ways, for example between other struts.

Figure 5:
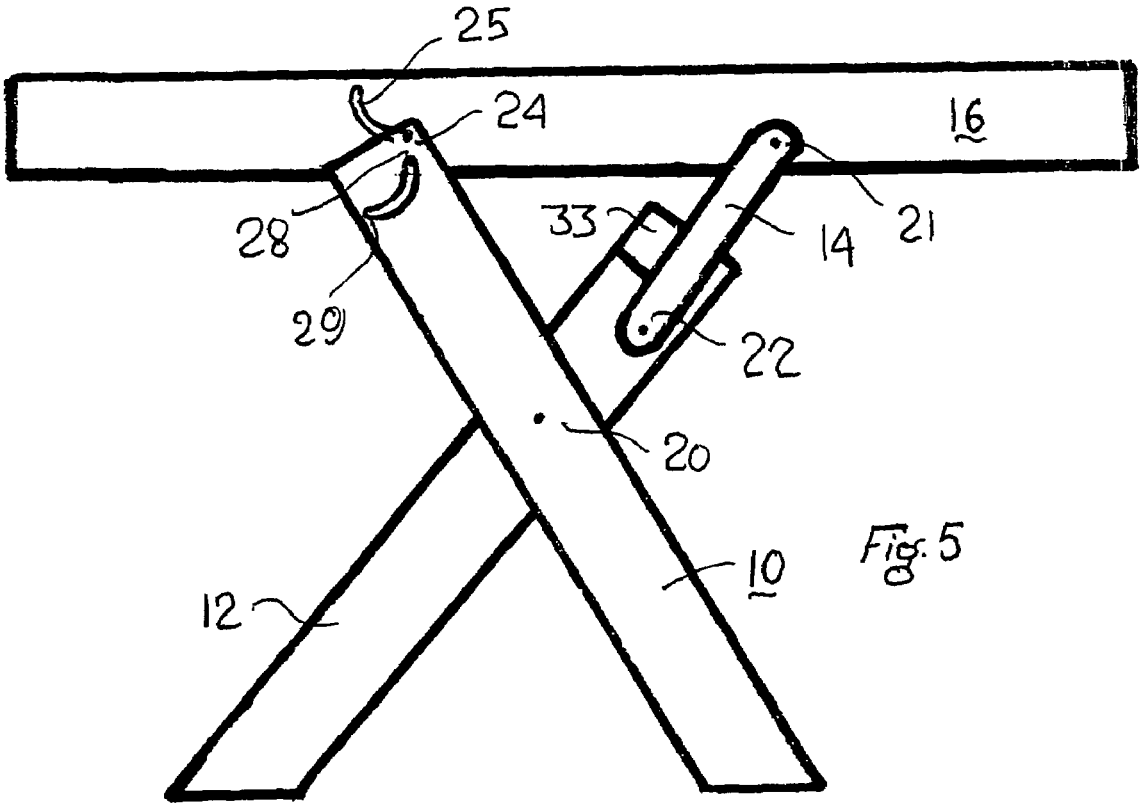
FIG. 5 shows a side elevation of a table.

Such a linkage could be used, (if necessary adapting the dimensions of the links) in other folding mechanisms. Referring to FIG. 5, a table or platform has a top 16, a first leg 10, and a second leg 15, the second leg being made up of an upper link 14 and a lower link 12. The upper link 14 is pivotally connected to the table top 16 at 21, and also pivotally connected to the lower link 12 at 22. The lower link is pivotally connected to the first leg 10 at 20. The first leg is connected by sliding pivot 23, 27 means to the table top. As in the last embodiment, the sliding pivot 23, 27 comprises a pin 24 fixed upon the first leg 10 which engages in a curved slot 25 on the side surface of the table top 16, and a pin 28 in the side of the table top which engages in a similar curved slot 29 in the first leg. The operation of the table is similar to the previously described operation of the chair; in the table's open position, as shown in the figure, the upper 14 and lower links 12 are constrained by a stop member 33 from reducing the internal angle between the two links, and are prevented from increasing the internal angle between themselves by the weight of the table top and whatever may be on top of it. The pin 24 of the first leg 10 is located at the lower end of the table top's curved slot 25, whilst the pin of the table top 28 is located at the upper end of the first leg's curved slot 29. In order to fold the table, the upper and lower links of the second leg may be pushed by the user so that internal angle is increased and they pass through collinear alignment. The compressive force of the table on the upper and lower links will thereafter tend to cause them to fold together, further increasing the internal angle between them. As the distance between pivot 20 and pivot 21 is decreased, the first leg 10 is caused to fold generally against the table top 16, the pin 24 of the first leg moving towards the upper end of the table top's curved slot 25, whilst the pin 28 of the table top moves towards the lower end of the first leg's curved slot 29. The pivoting movement of the first leg 10 with respect to the table top 16 is approximately a rotation about a point beyond the top end of the first leg.

The first and second legs fold so that their side profiles substantially coincide with that of the table top, in a similar manner to that of the previously described chair. It will similarly be realised that the legs may be constrained by a cutaway portion rather than a slot, and also that the slot or cutaway portion need not necessarily be curved.

Figure 6:
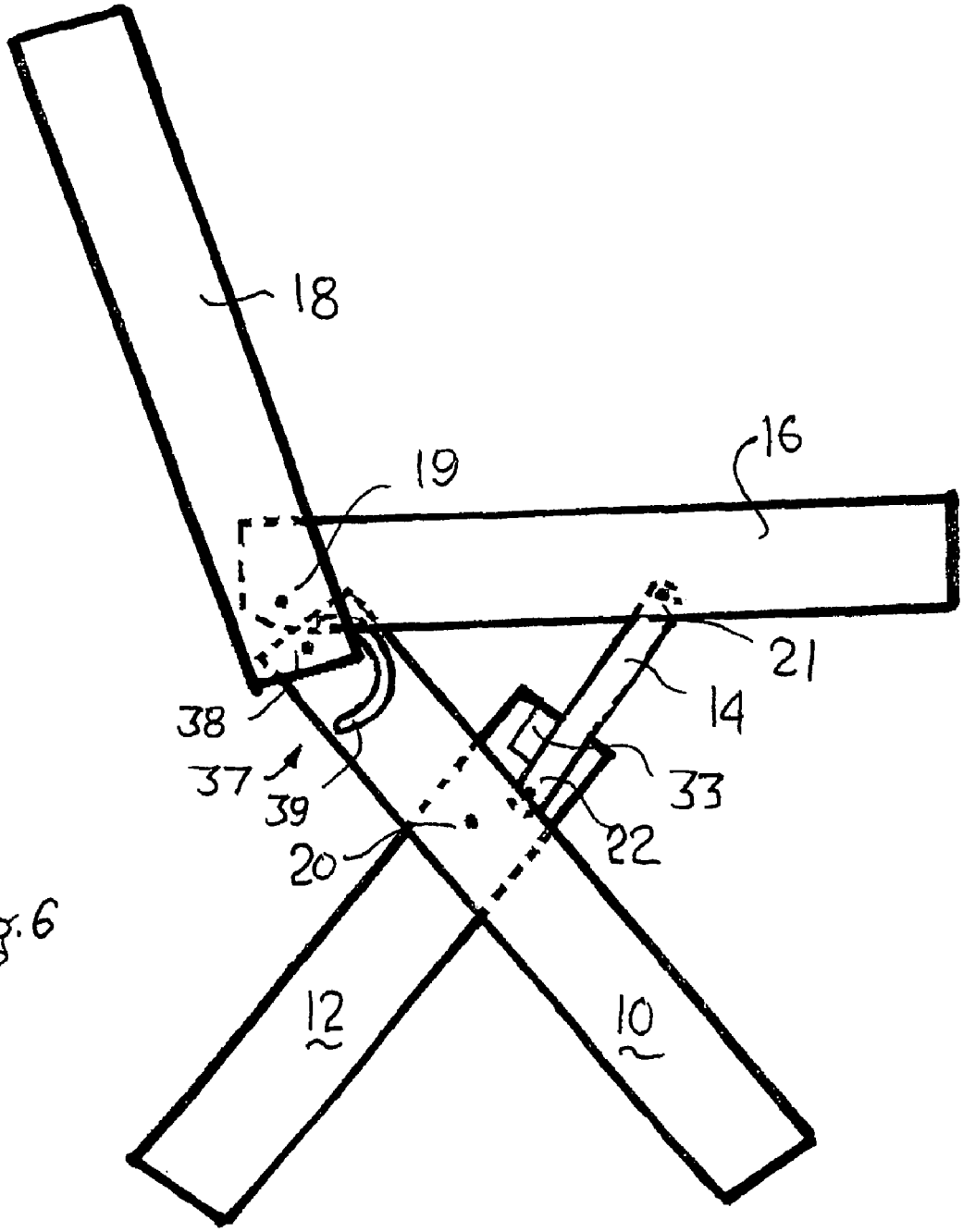
FIG. 6 shows a side elevation of another embodiment of a chair.

Referring to FIG. 6, a chair includes a rear leg made up of a upper rear leg strut 14 pivotally joined to a lower rear leg strut 12, a front leg strut 10 pivotally joined to the lower rear leg strut 12, and a seat strut 16 pivotally joined to the upper rear leg strut 14. The front leg strut 10 is attached by a slidable pivot 37, comprising a pin 38 attached to the seat strut 16 which engages with a curved slot 39 in the front leg strut 10. A back strut 18 is joined to front leg strut at pin 38, and also to seat strut 16 by a pivot 19.

The movement of the front leg strut 10 relative to the seat strut 16 is constrained by the front leg strut's pin engaging the seat strut's curved slot and the position of the back strut 18 relative to the front leg strut 10, whereas in the previously described embodiment the position of the front leg strut 10 relative to the seat strut 16 is constrained by the front leg strut's pin engaging the seat strut's curved slot and the seat strut's pin engaging the front leg strut's curved slot. In the folded position, the seat strut 16, front leg strut 10, upper rear leg strut 14, lower rear leg strut 12 and back strut 18 are substantially aligned on top of each other. By rotating the back strut 18 relative to the seat strut 16 about pivot 19, the front leg strut 10 rotates about the pivot 19 and the sliding pivot 37, in turn causing the upper rear leg strut 14 and lower rear leg strut 12 unfold to their open position. As in the previous examples, the upper rear leg strut 14 and lower rear leg strut 12 include a stop member 33 that prevents the upper rear leg strut 14 and the lower rear leg strut 12 from continuing to pivot so as to increase the internal angle between them at some point after they have passed through a collinear position, so that downward force on the chair causes the upper rear leg strut 14 and lower rear leg strut 12 to become braced, fixing the chair's position securely. To fold the chair, the chair may be lifted from a point behind the chair's centre of gravity, particularly at the pivot region 38. The pin 38 is preferably located at or close to the middle of the thickness of the front leg strut 10. When lifted in this manner, the struts fold together under their own weight.

Figure 7:
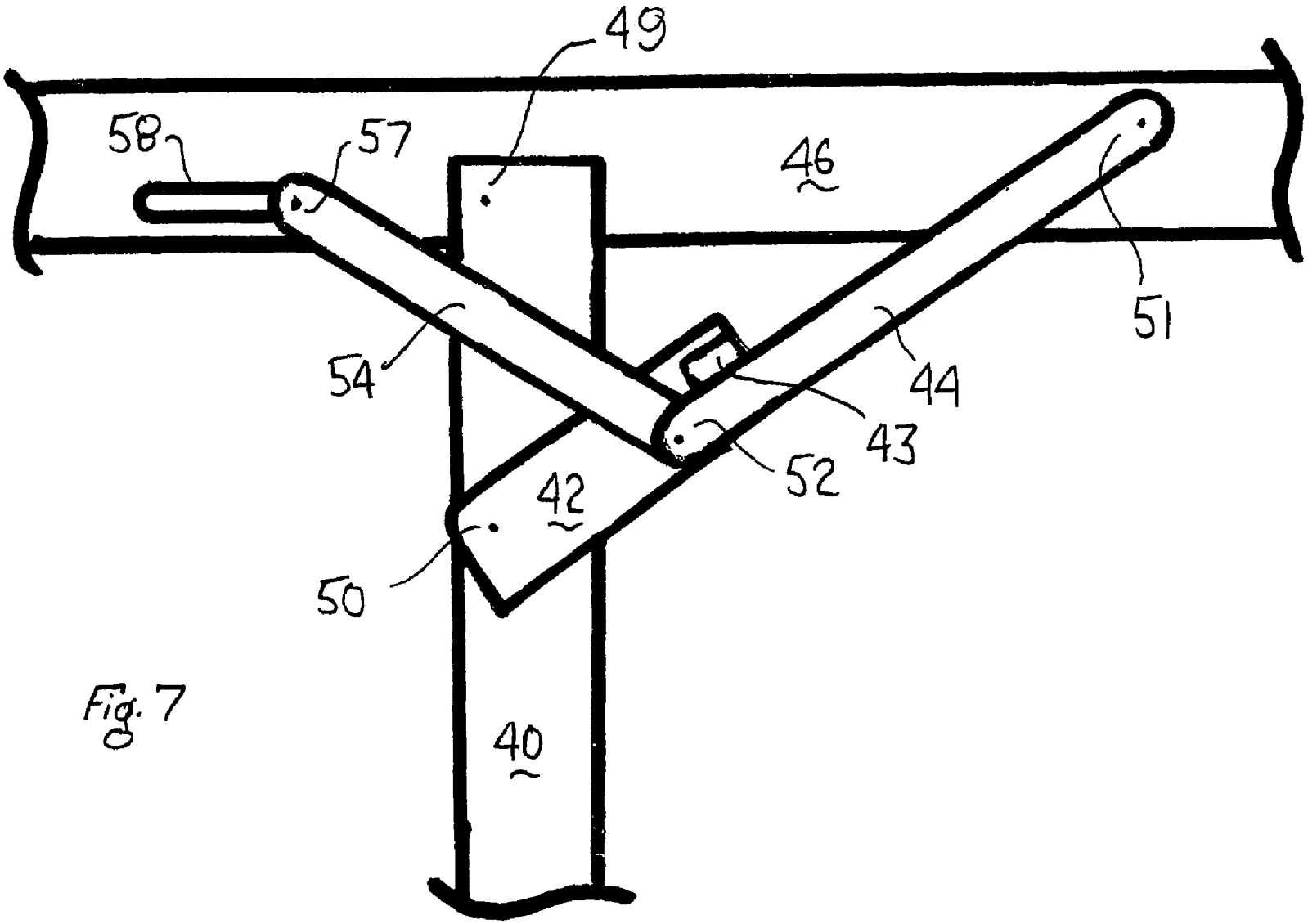
FIG. 7 shows a side elevation of another embodiment of a table.

Referring to FIG. 7, a table includes a table top 46, a leg 40 pivotally joined to the table top 46 at 49, a bracing strut 45 comprising an upper strut 44 pivotally joined to the table top at 51, and a lower strut 42 pivotally joined to the upper strut 44 at 50, and pivotally joined to the leg 40 at 50. At the pivot 42 between the upper strut 44 and the lower strut 42 a release bar 54 is pivotally joined at 55, the release bar 54 is also slidably joined to the table top 46. In the open position, the leg 40 is substantially vertical, and the upper and lower struts 44,42 are generally collinear. As in the previous embodiments, the upper and lower strut 44,42 are not precisely collinear, but have passed somewhat beyond alignment so that the internal angle between the upper and lower struts is greater than 180° before further movement is prevented by a stop member 43. In this manner, downward force on the table opposes any reduction of the internal angle between the upper strut and lower strut 44,42, securing the table in the open position.

In order to slide relative to the table top, the release bar includes a slider pin 57 which engages in a horizontal track 58 in the table top 46. When the table is in the open position, the slider pin 57 is situated at the end of the track 46 closest to the leg 40. The release bar 54 also includes a handle at the slider pin 57 extended outward from the table top 46. The table may be conveniently folded by pulling upon the handle of the release bar so that the release bar 54 is pulled away from the leg 40, causing the upper and lower struts 44,42 to be pivot relative to one another so as to move through the collinear position and decrease the internal angle between them. After the upper and lower struts have passed through the collinear position, downward force on the table will act to increase the internal angle between the upper and lower struts. As the upper and lower struts fold together, the leg is drawn towards the table top, pivoting about 49. The leg continues to pivot until it is lying coincident with the table top 46. At this point, the upper and lower struts 44,42 have also fully folded and are lying aligned with the table top. The release bar 54 is also aligned with the table top 46, the slider pin now 57 situated at the end of the track 58 furthest from the leg 40. Some type of stop means, such as a flange extending from the table top surface, is included to prevent the table leg 40 from pivoting above the table top.

The table will ideally have four legs constructed in this fashion; the legs may be linked in pairs, by horizontal cross pieces, in which case a single release bar could be provided for each pair of legs. Further, a single release bar suitably linked to four legs in order to over-centre the bracing struts could be provided so that the table could be folded in a single simple operation.

It will be realized that the pivoting struts, when considered in the plane in which they pivot, may be assembled in many orders, that is, when considered from the side one strut may be placed either in front of or behind one another.

The pivot 49 of table leg 40 may engage in a curved slot provided on the table, so that the leg, as it is folded, also rises to ensure that the side elevation coincides with that of the table top. As in the previously described embodiments, the table top may be provided with a pin which engages in a curved slot on the table leg 40.

It will be seen that the linkages disclosed may be applied in many different articles where it is necessary or desirable to have an article that may be folded between an expanded, open, configuration and a folded, compact configuration. In different articles, it may be necessary to vary the relative dimensions of the links and to extended them beyond the pivot points according to the nature of the article. Further, it will be realised that the principles disclosed herein could be implemented using equivalent linkages. Also, each linkage here has an over-centered bracing member comprising two struts such that, when braced, the links between the pivots include a re-entrant angle; it will be appreciated that the braced position could be achieved by the bracing member not forming a re-entrant angle, but instead folding to the article's closed state in a re-entrant manner, increasing the internal angle.

The invention claimed is:

1. A linkage mechanism including four pivoting bars, having an open position in which the first bar forms one side of a substantially triangular shape, the second and third bars are generally collinear to form a second side of the triangular shape, and the fourth bar forms a third side of the triangular shape, and a closed position in which the first bar, second bar, third bar and fourth bar are substantially aligned, the first bar being pivotally joined to the second bar, the second bar being pivotally joined to the third bar, the third bar being pivotally joined to the fourth bar, and the fourth bar being pivotally linked to the first bar by a pivot which moves along a curved path such that no point on the first bar remains coincident with any point on the fourth bar during relative movement of said first and fourth bars, a fifth bar being pivotally attached to the first bar.

2. A mechanism according to claim 1 wherein the path is provided by a cammed surface of the first bar in which a pin attached to the fourth bar slidably abuts.

3. A mechanism according to claim 2 wherein the cammed surface is a curved slot in which the pin slidably engages.

4. A mechanism according to claim 1 wherein said path is provided by a curved slot in the fourth bar in which a pin attached to the first bar slidably engages.

5. A mechanism according to claim 1 wherein the linkage forms part of a chair, the second and third bar being part of one leg of the chair, and the fourth bar forming part of another leg of the chair.

6. A mechanism according to claim 5 wherein the chair includes a surface adapted for handling located rearward of the chair's center of gravity.

7. A linkage mechanism including four pivoting bars, having an open position in which the first bar forms one side of a substantially triangular shape, the second and third bars are generally collinear to form the second side of the triangular shape, and the fourth bar forms the third side of the triangular shape, and a closed position in which the first bar, second bar, third bar and fourth bar are substantially aligned, the first bar being pivotally joined to the second bar, the second bar being pivotally joined to the third bar, the third bar being pivotally joined to the fourth bar, and the fourth bar being pivotally linked to the first bar by a pivot which moves along a curved path such that no point on the first bar remains coincident with any point on the fourth bar during relative movement of said first and fourth bars, the second bar and the third bar being constrained such that they pass through a precisely collinear relationship when the mechanism is transformed from the folded state to the open state and are held in a braced state in the open position when subjected to compressive forces.

8. A mechanism according to any claim 7 wherein a fifth bar is pivotally attached to the first bar.

9. A mechanism according to claim 8 wherein the fifth bar is also pivotally attached to the fourth bar.

10. A linkage mechanism including four pivoting bars, having an open position in which the first bar forms one side of a substantially triangular shape, the second and third bars are generally collinear to form the second side of the triangular shape, and the fourth bar forms the third side of the triangular shape, and a closed position in which the first bar, second bar, third bar and fourth bar are substantially aligned, the first bar being pivotally joined to the second bar, the second bar being pivotally joined to the third bar, the third bar being pivotally joined to the fourth bar, and the fourth bar being pivotally joined to the first bar by a pivot which moves along a curved path such that no point on the first bar remains coincident with any point on the fourth bar during the relative movement of said first and fourth bars, the second bar and the third bar being constrained such that they pass through a precisely collinear relationship when the mechanism is transformed from the folded state to the open state and are held in a braced state in the open position when subjected to compressive forces, and there being provided a release member attached to the second and/or the third bar capable of displacement causing the second bar and third bar to pass through the precisely collinear relationship in order to remove the braced state so that the mechanism can be folded.

11. A linkage mechanism according to claim 10 wherein the release member comprises a bar which is slidably pivoted with the first bar.

12. A mechanism according to claim 10, wherein the release bar includes a handle.

13. A mechanism according to claim 10 wherein the linkage forms part of a raised platform, the fourth bar forming part of a platform support and the first bar forming part of the platform surface.

14. A folding chair, including seat bar pivotally joined to a upper first leg bar, the upper first leg bar being pivotally joined to a lower first leg bar, the lower first leg bar being pivotally joined to a second leg bar, the second leg bar being pivotally joined to the seat bar, having an open position in which the seat bar forms one side of a substantially triangular shape, the upper first leg bar and lower first leg bar are generally collinear to form a second side of the triangular shape, the second leg bar forming a third side of the triangular shape, and a closed position in which the seat bar, upper first leg bar, lower first leg bar and second leg bar are substantially aligned the second leg bar being joined to the seat bar by a pivot which moves along a curved path with respect to the seat bar, the curved path being provided by a curved slot in the fourth bar in which a pin attached to the first bar slidably engages.

15. A mechanism according to claim 14 wherein path is provided by a cammed surface of the seat bar in which a pin attached to the second leg bar slidably abuts.

16. A mechanism according to claim 15 wherein the cammed surface is a curved slot in which the pin slidably engages.

17. A folding chair, including seat bar pivotally joined to a upper first leg bar, the upper first lea bar being pivotally joined to a lower first lea bar, the lower first lea bar being pivotally joined to a second leg bar, the second lea bar being pivotally joined to the seat bar, having an open position in which the seat bar forms one side of a substantially triangular shape, the upper first lea bar and lower first leg bar are generally collinear to form the second side of the triangular shape, the second leg bar forming the third side of the triangular shape, and a closed position in which the seat bar, upper first lea bar, lower first leg bar and second lea bar are substantially aligned the second leg bar being joined to the seat bar by a pivot which moves along a curved path with respect to the seat bar, a back bar being pivotally attached to the seat bar.

18. A mechanism according to claim 17 wherein the curved path is provided by a curved slot in the fourth bar in which a pin attached to the first bar slidably engages.

19. A folding chair, including seat bar pivotally joined to a upper first leg bar, the upper first leg bar being pivotally joined to a lower first leg bar, the lower first leg bar being pivotally joined to a second leg bar, the second leg bar being pivotally joined to the seat bar, having an open position in which the seat bar forms one side of a substantially triangular shape, the upper first leg bar and lower first leg bar are generally collinear to form a second side of the triangular shape, the second leg bar forming a third side of the triangular shape, and a closed position in which the seat bar, upper first leg bar, lower first leg bar and second leg bar are substantially aligned the second leg bar being joined to the seat bar by a pivot which moves along a curved path with respect to the seat bar, the upper first leg bar and the lower first leg bar being constrained such that they pass through a precisely collinear relationship when the mechanism is transformed from the folded state to the open state and are held in a braced state in the open position when subjected to compressive forces.

* * * * *